United States Patent [19]

Kinnan

[11] Patent Number: 4,630,972

[45] Date of Patent: Dec. 23, 1986

[54] IMPULSE INJECTOR APPARATUS

[75] Inventor: Frank R. Kinnan, Winston, Oreg.

[73] Assignee: Utilitech, Incorporated, Sam Ramon, Calif.

[21] Appl. No.: 666,292

[22] Filed: Oct. 29, 1984

[51] Int. Cl.[4] ..... E02D 3/12; F15B 7/00

[52] U.S. Cl. ..... 405/269; 405/258; 60/370; 222/334

[58] Field of Search ..... 405/248, 247, 266, 269, 405/258, 263-265, 270, 303; 222/334, 340, 389; 60/370

[56] References Cited

U.S. PATENT DOCUMENTS

| | | | |
|---|---|---|---|
| 2,960,831 | 11/1960 | Lonaberger et al. | 405/269 X |
| 3,363,512 | 1/1968 | Ottestad | 60/370 X |
| 3,363,513 | 1/1968 | Ottestad | 60/370 X |
| 3,601,285 | 8/1971 | Leger | 222/334 X |
| 3,601,987 | 8/1971 | Chermensky | 222/334 |
| 3,601,988 | 8/1971 | Chermensky | 222/334 |
| 4,449,856 | 5/1984 | Tokoro et al. | 405/269 |

FOREIGN PATENT DOCUMENTS

| | | | |
|---|---|---|---|
| 85419 | 5/1982 | Japan | 405/266 |

*Primary Examiner*—Cornelius J. Husar
*Assistant Examiner*—Nancy J. Stodola
*Attorney, Agent, or Firm*—Kolisch, Hartwell & Dickinson

[57] ABSTRACT

An impulse injector apparatus operates to produce pulsed delivery of injected material, with the material moving during a delivery pulse at high velocity and under the urging of a compressed captured gas supply which is permitted to rapidly expand. The device includes an elongate cylinder and an actuating piston mounted for reciprocal movement within the cylinder. A captured compressible gas supply is located within a chamber which is defined between one end of the piston and one extremity of the cylinder. Another chamber is defined between the opposite end of the piston and the opposite extremity of the cylinder. A pressurized fluid is controllably admitted into the other chamber, thereby causing movement of the actuating cylinder towards the one extremity of the cylinder and resulting in compression of the captured gas supply. The control means then cause abrupt dumping of the pressure fluid from the other chamber whereupon the actuating piston is rapidly urged towards the opposite extremity of the cylinder under the effect of the captured gas supply. Material to be injected is received within an injection material chamber having an outlet at one end and injection piston movable within the chamber at the other end of the injection chamber. Means are provided to connect the actuating piston at the injection piston whereby movement of the actuating piston towards the opposite extremity of the cylinder produces movement of the injection piston towards the outlet end of the injection material chamber. A flexible conduit may be provided to connect the outlet to a nozzle which is movable independently of the apparatus. Additionally, the apparatus may be vehicle mounted for easy movement thereof.

7 Claims, 9 Drawing Figures

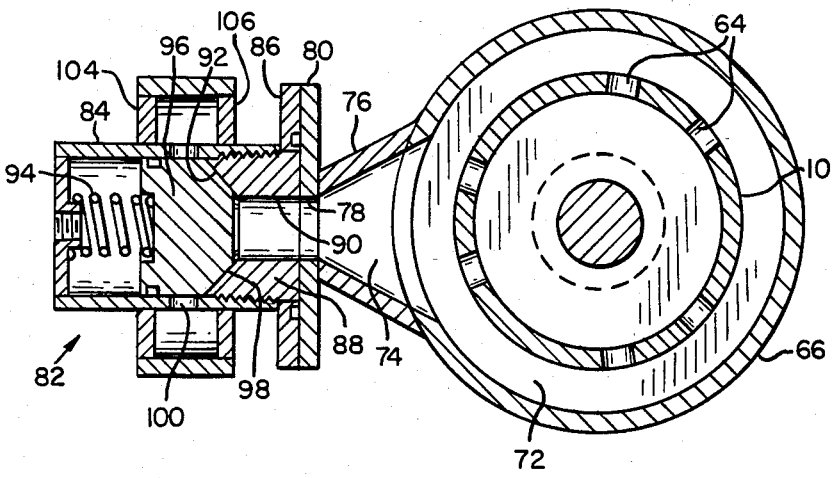
FIG. 3
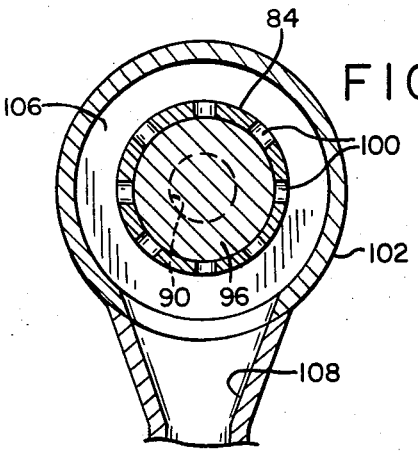
FIG. 4
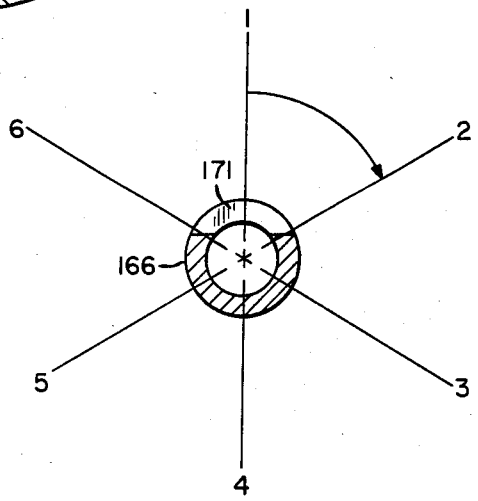
FIG. 8
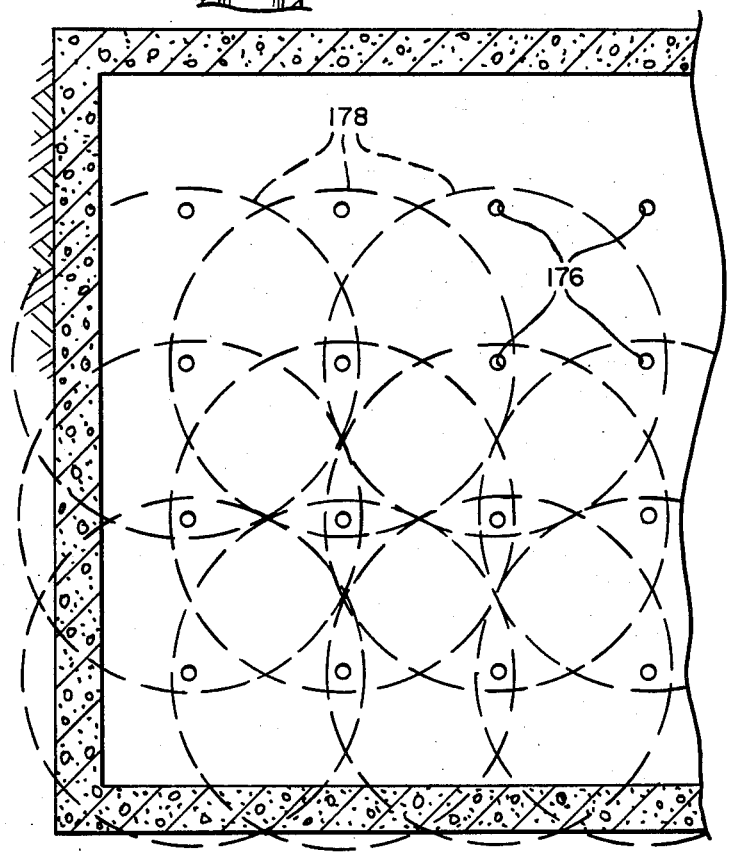
FIG. 7
FIG. 9
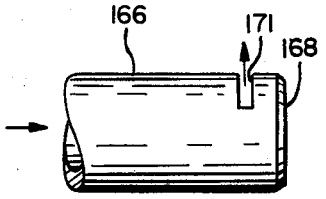

IMPULSE INJECTOR APPARATUS

BACKGROUND AND SUMMARY OF THE INVENTION

This invention relates to what is generally referred to here as impulse injector apparatus, and more particularly to injector apparatus which operates to produce pulsed delivery of injected material, with the material moving during a delivery pulse at high velocity and under the urging of a compressed captured gas supply which is permitted rapidly to expand.

Apparatus as contemplated by the invention has a vast variety of uses, as exemplified by some of the uses contemplated in the construction industry alone. For instance, and when using water as the material injected by the apparatus, it may be employed effectively to prepare elongate holes or bores extending into the ground, usable in mounting enforcement or anchoring bars. With a cementitous material, such as grout, the apparatus may be employed in preparing grout deposits within the ground, for anchoring the ends of reinforcement bars. Power companies and utilities use underground vaults for the housing of transformers, couplers and related equipment, and the apparatus of the invention may be usefully employed to reinforce and waterproof the walls of such vaults with the injection of grout, bentonite slurry, or whatever other material is dictated by the specific repair operation. In these and other uses, high-velocity, pulse-type injections produced by the apparatus result in a speedy and thorough penetration of the ground by the injected material. By explaining some of the contemplated uses of the equipment, it is not intended to limit the invention, as the apparatus has obvious utility in other operations where high-velocity, pulsed injections are desired.

The impulse injector of the invention is simply constructed, rendering it easy to repair and maintain. It is relatively easily incorporated with a vehicle equipped with a power driven pump, to produce an injection instrumentality readily moved from one place to another. The output from the injector apparatus may be delivered through a flexible hose or conduit to an operator manipulated nozzle, which diverts the injection material to the precise location desired.

A general object of this invention, therefore, is to provide improved apparatus for producing pulsed injections of material delivered at high velocities.

Another object is to provide such apparatus which is operated through controlled, sequential delivering and then dumping of hydraulic pressure fluid to and then from operating parts of the apparatus.

Yet another object is to provide injector apparatus producing a pulsed injection of material, where the material is propelled from the equipment under the urging of a rapidly expanding, compressed, captured gas supply.

Another object is to provide such apparatus which includes a flexible conduit receiving pulses of injection material, and a nozzle member joined with this conduit directing the material to the desired final location.

In one form of the invention, an interspersing device is provided which can be controlled to supply the nozzle member first with one type of injection material supplied from another source than the impulse injector, and subsequently with a pulse of injection material supplied from the impulse injector.

These and other objects and advantages are attained by the invention, which is described hereinbelow in conjunction with the accompanying drawings, wherein:

FIG. 3 is a cross-sectional view, taken generally along the line 3—3 in FIG. 1;

FIG. 4 is a cross-sectional view, taken generally along the line 4—4 in FIG. 1;

FIG. 7 is a view taken generally along the line 7—7 in FIG. 6, on a slightly larger scale;

FIG. 8 is a cross-sectional view of the nozzle member, taken along the line 8—8 in FIG. 6 and on a larger scale; and FIG. 9 is a view, on the same scale as FIG. 8, showing the end of the nozzle member from its side.

Figure 1:
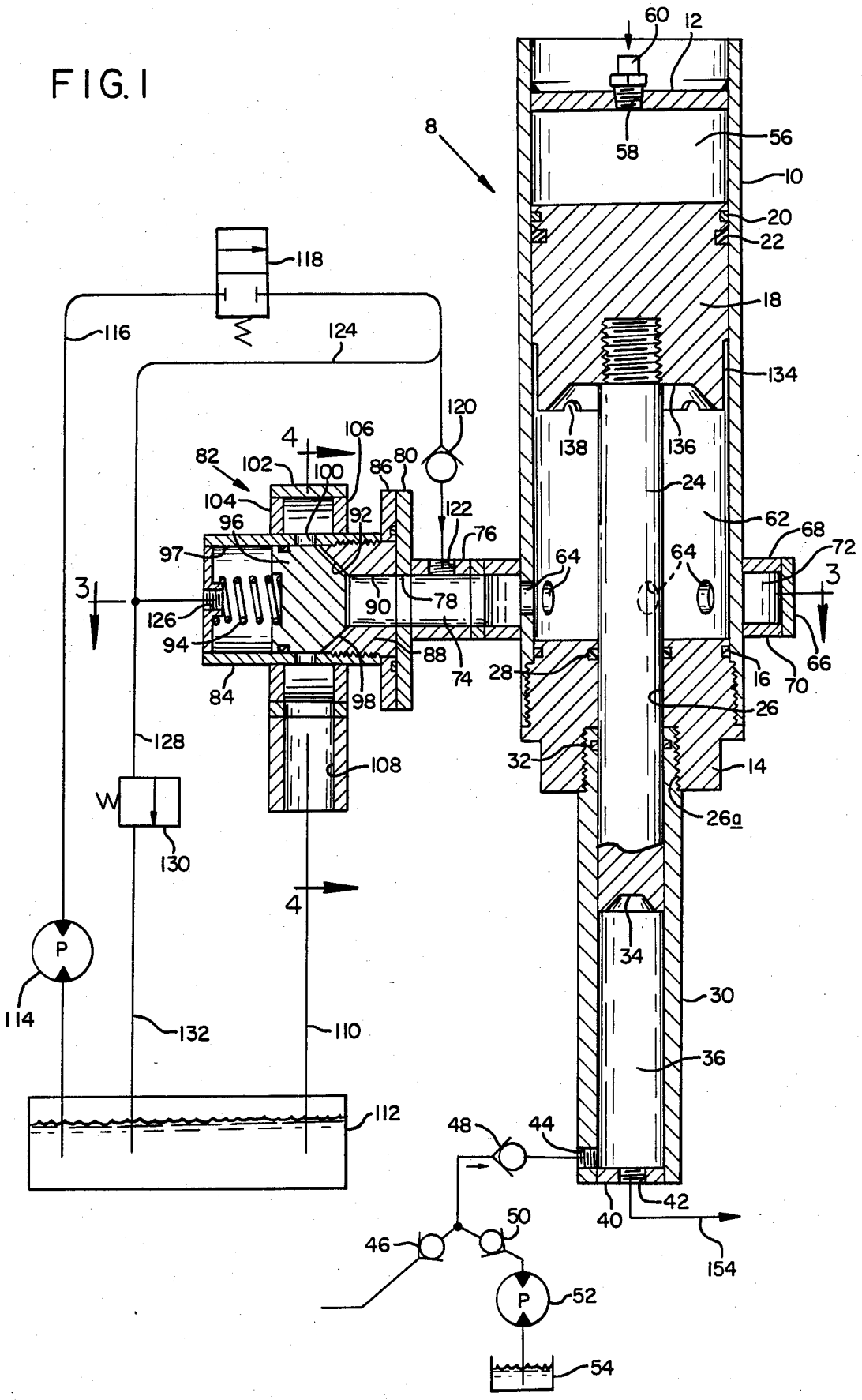
FIG. 1 is a view illustrating, in cross-section, impulse injector apparatus as contemplated herein, and further illustrating schematially control means for the apparatus.
Figure 2:
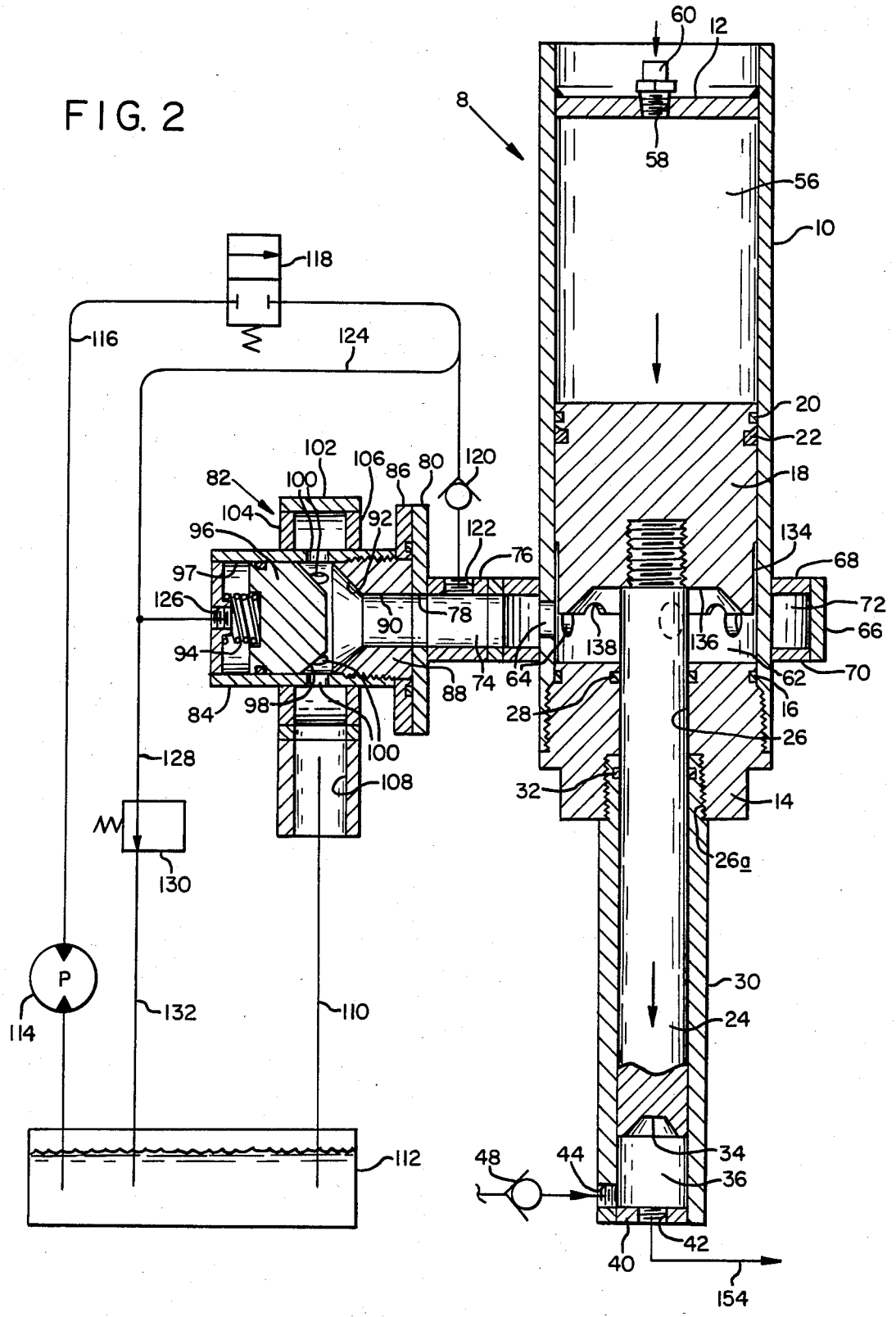
FIG. 2 is a view similar to FIG. 1, but illustrating the apparatus with parts therein as they would appear at a different stage of operation.

Referring now to the drawings, and more particularly initially to FIGS. 1 and 2, the impulse injector shown at 8 includes an elongate upright cylinder 10 closed off at its upper end by end wall 12 suitably secured as by welding to the interior to the cylinder. The bottom end of the cylinder is closed off by end plug 14, which is externally threaded and is screwed into internal threads formed on the interior of cylinder 10. Sealing the plug to the cylinder is seal 16.

Mounted for reciprocation within cylinder 10 is an actuating piston 18 provided with seals 20, 22 sealing the exterior of the piston to the interior of the cylinder. A piston rod 24 secured to the piston by a threaded connection between the end of the rod and the piston extends downwardly from the piston and through a bore 26 outwardly from the lower end of cylinder 10. Seal 28 provides a seal between the piston rod and the plug.

Bore 26 is enlarged at **26*a* and such is internally threaded. An elongate cylinder 30 is secured to end plug 14 through screwing an externally threaded upper end portion thereof into internally threaded bore enlargement 26*a*. Piston rod 24 extends downwardly into the interior of this cylinder, and providing a seal between the exterior of the piston rod and the interior of the cylinder is seal 32. Piston rod 24 terminates in a concave piston face 34**.

The interior of cylinder 30 provides a chamber 36 adapted to receive material to be injected, referred to as "injection material". Exemplifying such material is water, which may be used, for instance, in drilling or for propelling another material placed in advance of the water. Alternatively, the injection material may be a cementitous grout mixture, or a bentonite and water slurry, usable, for instance, in strengthening or waterproofing underground structures. By indicating a few types of injection materials, it is not intended to preclude the use of others. For instance, the injection material might comprise a resin solution employed to increase soil strengths, an electrolytic chemical solution employed to decrease soil resistivity, or a fumigant solution employed for fumigation purposes.

The bottom end of cylinder 30 is closed off by end wall 40. Material is injected from chamber 36 through an internally threaded discharge opening 42 provided in end wall 40.

Material is admitted to the injection material chamber through threaded inlet opening 44. Schematically indicated in FIG. 1 is one of a variety of systems that may be employed to supply injection material to chamber 36. The system illustrated may be utilized to supply water through a conduit system including check valves 46, 48 connecting with inlet opening 44, or alternatively a conduit system including check valves 50 and 48 connecting the discharge of a pump 52 pumping material from a supply 54.

From the structure described, it should be apparent that with downward movement of actuating piston 18 within cylinder 10 conjoint downward movement of the lower end of rod 24 (also referred to herein as an injection piston) occurs within chamber 30. With the cross-sectional area of the bottom end of rod 24, being only a minor portion of the cross-sectional area of the actuating piston (in the particular construction illustrated, the ratio of these cross-sectional areas is approximately 1 to 10), the injection material is injected from the injection chamber with a propelling force which is substantially greater than any force which propels the actuating piston downwardly within cylinder 10.

A chamber 56 is defined between the upper end of actuating piston 18 and end wall 12. This chamber is utilized to contain what is referred to herein as a captured compressible gas supply, which may be, for example, nitrogen supplied to the chamber under pressure. By way of example, nitrogen has been utilized supplied to this chamber with the actuating piston at its fully lowered position within cylinder 10 at a pressure of 300 psi. The nitrogen is introduced to the chamber through inlet opening 58 closed off by fitting 60.

Defined between the bottom end of actuating piston 18 and end plug 14 is a chamber 62. The impulse injector is placed in a charged or cocked condition (illustrated in FIG. 1), through the admission of hydraulic fluid under high pressure into chamber 62. By way of example, hydraulic fluid at 2,000 psi has been employed for this purpose. With admission of such pressure fluid to chamber 62, actuating piston 18 moves upwardly to highly compress the captured compressible gas supply in chamber 56. With this pressure fluid abruptly released for dumping from chamber 62, the actuating piston is propelled abruptly downwardly within cylinder 10 by the peaked pressure of the gas contained within chamber 56.

Explaining now in fuller detail the structure provided for admitting and then dumping such pressure fluid, and referring now to FIGS. 1 and 3, shown at 64 are a series of circumferentially distributed apertures or ports extending through cylinder 10 in a zone spaced slightly above the top of end plug 14. A cylindrical wall 66 and annular walls 68, 70, all suitably joined to each and to cylinder 10, define an annular passageway extending about the cylinder interconnecting the various port 64. This passage connects with a throat 74 formed by wall structure 76. This throat communicates with a hole 78 provided in a flange plate 80 terminating wall structure 76.

A dump valve assembly is shown in 82. Such includes a cylindrical body shell 84 joined to a flange plate 86 which abuts and is sealed to flange plate 80, the flange plates 86, 80 being suitably secured together in this position.

A dump valve seat element 88 screwed into the interior of body shell 84 has a central passage 90 communicating with hole 78. Seat element 88 terminates in a frusto-conical seat surface 92.

Urged against this seat surface by a spring 94 is a dump valve piston 96 terminating in a frusto-conical surface 98 that abuts surface 92 with the valve assembly in a closed position, as shown in 51. Chamber 97 is defined behind the dump valve piston.

Referring to FIGS. 1, 3, and 4, body shell 84 is provided with ports 100 distributed circumferentially thereabout. Forming a channel extending about the body shell, and interconnecting these ports, is a cylindrical wall 102 and end walls 104, 106. This channel connects through a throat 108 to a dump conduit or line, indicated schematically at 110 dumping fluid passing therethrough into reservoir 112.

Considering the control means for the pressurized hydraulic fluid and the pumping system, hydraulic fluid is pumped from reservoir 112 by pump 114 through line 116, valve 118, check valve 120, and inlet port 122, to be delivered to throat 74 leading to passage 72 defined about the exterior of cylinder 10. Such pressure fluid is also supplied through line 124 and inlet port 126 of the dump valve assembly to fill chamber 97 defined behind dump valve piston 96. Line 124 also connects via line 128, valve 130, and line 132, to reservoir 112.

Explaining the operation of the impulse injector and the controls therefor, the injector is placed in a charged or cocked position through opening of valve 118 which introduces pressure fluid behind the dump valve piston and introduces pressure fluid to passage 72, such fluid flowing into the interior of cylinder 10 through port 64. The dump valve assembly is maintained closed by the pressure fluid behind the dump valve piston. Actuating piston 18 is forced upwardly with compression of the compressible gas supply within chamber 56. With such upward movement, injection material is fed into the injection material chamber 36 via inlet opening 34.

The apparatus is actuated to produce a pulsed injection of material through discharge opening 32 through opening of valve 130. This permits pressure fluid to escape from chamber 97 located behind the dump valve piston 96.

As perhaps best illustrated by comparing FIGS. 1 and 2, with the supply of pressure fluid to throat 74 and passage 72 shut off, and with valve 130 open to permit the escape of pressure fluid from chamber 97, actuating piston 18 is freed for rapid movement downwardly within cylinder 10 under the urging of the pressurized gas contained within chamber 56. Fluid dumps from chamber 62 located under the lower end of the actuating piston through passage 72, throat 74, now open passage 90, ports 100, and throat 108, into reservoir 112. Injection material is injected from the injection chamber 36, in a pulse-type discharge, as the result of the rapid downward movement of the injection piston within the injection chamber.

Provided to decelerate movement of piston 18 as it approaches its lowered position within cylinder 10, and thus to prevent abrupt stopping of the piston and the shock that would result, is what is referred to as a deceleration collar construction provided for the bottom end of the piston.

More specifically, it will be noted with reference to FIGS. 1 and 2 that the side of actuating piston 18 adjacent its lower end is circumferentially recessed at 134. This lower portion has a slightly smaller diameter than the diameter of the remaining part of the piston. Furthermore, the bottom end of the piston is dished by the provision of an axially indented recess 136. Additionally, notches, such as notch 138, are provided distributed about the lower end of the piston, connecting the axially indented recess with circumferential recess 134.

As a result of this construction, the flow of hydraulic fluid from chamber 62 is not abruptly stopped with the lower part of the piston side moving into a fully covered relationship with respect to ports 64. Instead, as the piston moves downwardly, there is initially partial closing of ports 64. The closing becomes greater, but never complete, with further downward movement of the piston. Metered flow of fluid is provided through the notches described and the cylindrically recessed portion of the piston.

In the usual instance, the output of the impulse injector is connected to some sort of nozzle device which directs the injected material. The connection between the output, i.e., discharge opening 42, and this nozzle is by a flexible conduit which accommodates controlled varied positioning of the nozzle member independently of the position of the impulse injector proper.

Figures 5, 6:
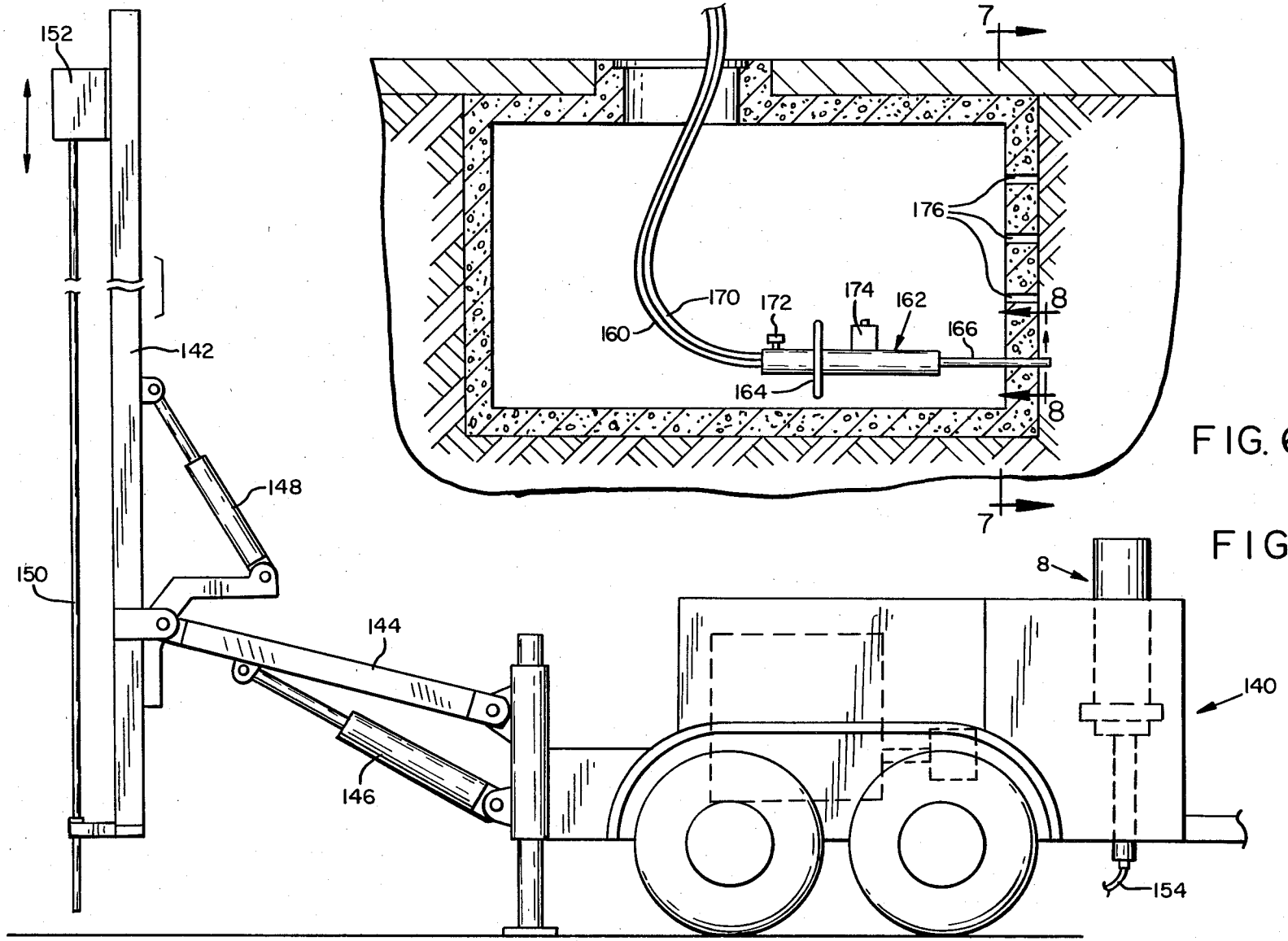
FIG. 5 is a view showing in somewhat simplified form the impulse injector apparatus incorporated with a vehicle and employed to operate a drill rod mounted on a mast provided in the vehicle.
FIG. 6 is a view illustrating in cross-section an underground vault, and showing how a nozzle member connected to the impulse injector may be employed in sealing underground walls in the vault.

Referring to FIG. 5, here impulse injector 8 is shown mounted on a vehicle such as the trailer vehicle designated at 140. An upright mast 142 carried at one end of this trailer vehicle is mounted on the frame of the vehicle through pivoted link structure 144 and extensible-contractable piston-cylinder assembly 146. Additionally provided for changing the attitude of mast 142 with respect to the ground is extensible-contractable piston-cylinder assembly 148.

An elongate hollow drill rod is shown at 150 which is provided at the base thereof with a nozzle orifice (not shown). During use, this drill rod is rotated under power by rotary drive unit 152. The drill rod and unit 152 are moveable as a unit downwardly along the upright mast through conventional poweroperated means (not shown) normally associated with structure of this description. A flexible conduit, partially shown at 154, extends from the discharge orifice of the impulse injector to a connection with the interior of the hollow drill rod at the upper end of this rod.

In operation, and using, by way of example, water as the injection material, with successive actuations of the impulse injector, volumes of water are propelled at high velocity out from the injection chamber 36 of the injector into conduit 154 and into the hollow drill rod, to be injected from the drill rod at the nozzle orifice provided at the bottom end of the rod. With the rod rotated and simultaneously lowered into the ground, the rod is effective rapidly and efficiently to prepare an elongate bore into the ground, usable for instance in the installing of anchor rods and ground rods. Using a cementitous grout mixture as the injection material, such can be delivered through a hollow rod such as rod 150 to a region adjacent the base of a bore so drilled, to provide a collection of grout for anchoring a rod so installed.

FIG. 6 illustrates how the impulse injector may be utilized in the injection of grout to the earth exposed side of an underground vault wall, for the purpose of producing a water seal thereover. In this illustration of the invention, the discharge opening 42 of the impulse injector is connected via a conduit 160 to what is referred to herein as an interspersing device 162 which the operator supports and is able to rotate generally about the axis thereof, using handle 164. An elongate nozzle member 166 extends out from the interspersing device.

As perhaps best illustrated in FIG. 9 the nozzle member has a closed end 168 and a side opening 171, so that material is discharged from the nozzle member by traveling through this side opening and in a direction which is at 90° to it's travel down the length of the nozzle member.

Also connecting with the interspersing device is a conduit 170 which may carry a grout slurry mixture delivered to the interspersing device under moderate pressure.

A valve shown at 172 in the interspersing device has a normal position where conduit 160 is connected through the interspersing device with the nozzle member 166. However, with actuation of the valve, this connection is cut off and instead conduit 170 is connected to the nozzle member. Control means 174 of the interspersing device is actuated to trigger impulse injector 8.

Using this type of equipment, an operator first, through actuation of valve 172, causes grout slurry delivered in conduit 170 to flow into the nozzle member thus to fill its interior. With the nozzle member filled, and with adjustment of valve 172 to connect conduit 160 to the nozzle member, the impulse injector may then be actuated through operation of control means 174. This results in a pulsed discharge of a charge of water from the impulse injector, which charge of water travels down conduit 160 to move against the grout material filling the nozzle member. The grout material together with the charge of water are then propelled outwardly through side opening 171 of the nozzle member.

In using this type of equipment to seal the exterior, ground-facing side of an underground vault, a grid pattern of bores, such as bores 176 shown in FIG. 7, is first prepared, with such bores extending through the vault wall. Starting with a bore such as the lower right-hand bore illustrated in FIG. 7, the operator inserts the nozzle member through the bore to place its side opening 171 a slight distance outwardly from the exterior wall surface. Pulsed injections of grout mixture and water may then be propelled into the ground, with the operator between successive pulses rotating the nozzle member about its axis a predetermined angular distance, such as 60°, as shown diagrammatically in FIG. 8. The pulsed injections so produced readily penetrate the ground, and produce a covered area approximately circular in outline surrounding the bore opening which contains the nozzle member. The process may then be repeated with other bores in the grid pattern, finally to produce a layer of grout on the exterior wall surface which is effective to completely seal the wall. In FIG. 7, the circular outlines of injected material produced by the method described are shown at 178.

While two particular applications have been specifically described for the impulse injector, it is not thereby intended to limit the invention to such particular applications. As earlier indicated, the injector has utility in a wide variety of applications where deposits of injected material are desired with such delivered at high velocity.

In this connection, it has been observed through tests performed that nozzle exit pressures in the range of 6,000 psi may be expected. The velocity of a charge of injected material may substantially exceed the velocity of a rifle bullet. The impulse injector contemplated, although having unique operating characteristics lending itself for a wide variety of uses, nevertheless is a relatively simply constructed device which is easily repaired and maintained.

While various modifications of the invention have been described herein, it is appreciated that other modifications and variations are possible without departing from the invention as herein claimed.

It is claimed and desired to secure by letters patent:

1. Intensified impulse injector apparatus comprising:
an elongate cylinder,
an actuating piston mounted for reciprocation within said cylinder,
a chamber within said cylinder defined between one end of the piston and one extermity of said cylinder and a captured compressible gas supply within this chamber,
another chamber within said cylinder defined between the opposite end of said piston and an opposite extremity of said cylinder,
a pressure fluid conduit connected to a supply of pressure fluid,
a drain conduit connected to a drain for the drainage of fluid,
control means for first selectively connecting the pressure fluid conduit to said other chamber to admit pressure fluid to said other chamber to cause movement of said actuating cylinder towards said one extermity of said cylinder and compression of said captured gas supply and for then selectively connecting the drain conduit to said other chamber to allow dumping of pressure fluid from said other chamber with said actuating piston moving toward said opposite extermity of the cylinder under the urging of expansion of said captured gas supply, said control means comprising aperture means in the side of said cylinder adjacent its said opposite extermity and said piston having a side that moves into covering relation over said aperture means on moving adjacent said opposite extremity of said cylinder,
means forming an elongated material-holding chamber for holding injection material having an oulet at one end and an injection piston movable within said material-holding chamber toward said one end of the material-holding chamber to cause discharge of the material from said outlet, and
means connecting the actuating piston and injection piston whereby movement of the actuating piston toward said opposite extremity of said cylinder produces movement of the injection piston toward said one end of the material-holding chamber.

2. The apparatus of claim 1, which further includes metering means interposed between the side of the piston and the inner wall of the cylinder accomdating limited metered flow of pressure fluid into said aperture means with said actuating piston in covering relation over said aperture means.

3. The apparatus of claim 1 wherein said aperture means comprises ports circumferentially distributed about the cylinder adjacent its said opposite extremity, said actuating piston having a side which moves into covering relationship over said ports on the piston moving adjacent said opposite cylinder extremity, said actuating piston having a recessed portion in the side thereof extending axially inwardly on the piston from said opposite end of the piston providing for metered flow into said ports with the side of the piston in covering relationship over said ports.

4. The apparatus of claim 1 wherein the aperture means comprises ports in the side of the cylinder circumferentially distributed about the side of the cylinder adjacent said opposite extremity of the cylinder, means forming a channel extending about the exterior of the cylinder connecting said ports on the outside of the cylinder, and dump valve means connected with said channel and controllable to permit dumping of fluid passing through said ports into said channel.

5. The apparatus of claim 4, wherein said dump valve means includes a dump valve piston and a valve seat element defining a valve opening which is closed with the dump valve piston seated on said valve seat element, means for admitting pressure fluid against said dump valve piston to produce seating of said dump valve piston on said seat element, said means including a control valve actuatable to relieve the pressure of said pressure fluid.

6. Intensified inpulse injector apparatus comprising:
an elongate cylinder,
an actuating piston mounted for reciprocal movement within said cylinder and a rod secured to said piston at one end thereof and extending from the piston out through one end of the cylinder, said piston dividing the interior of the cylinder into two chambers with one located between one end of the piston and said one end of the cylinder and the other located between the opposite end of the piston and the opposite end of the cylinder,
a captured compressible gas supply within said other chamber,
a pressure fluid conduit connected to a supply of pressurized hydraulic fluid,
a drain conduit connected to a drain for the drainage of fluid,
control means for first selectively connecting the pressure fluid conduit to said one chamber to admit hydraulic fluid under pressure to said one chamber thereby to cause the piston to move against the captured gas supply and to compress it and for then selectively connecting the drain conduit to said one chamber to allow abrupt release of hydraulic fluid from said one chamber, said control means comprising aperture means in the side of the cylinder adjacent said one end of the cylinder, means forming a channel joining said aperture means, and a dump valve controlling flow of fluid through said channel,
means adjacent said cylinder forming an elongate material-holding chamber for holding injection material, said piston rod extending into said material-holding chamber and terminating in a piston face closing off and movable within said material-holding chamber, said piston face moving toward an end of said material-holding chamber with movement of said actuating piston toward said one end of the cylinder, and
an outlet in said end of said material-holidng chamber accommodating discharge of injection material therethrough with movement of said piston face toward said one end of said material-holding chamber.

7. The apparatus of claim 6, which further includes metering means interposed between the side of the piston and the inner wall of the cylinder accommodating limited metered flow of hydraulic fluid into said aperture means with said actuating piston moved adjacent said one end of the cylinder.

* * * * *